US009135929B2

(12) United States Patent
Mundt et al.

(10) Patent No.: US 9,135,929 B2
(45) Date of Patent: Sep. 15, 2015

(54) EFFICIENT CONTENT CLASSIFICATION AND LOUDNESS ESTIMATION

(75) Inventors: Harald H. Mundt, Fürth (DE); Arijit Biswas, Nuremberg (DE); Rolf Meissner, Petersaurach (DE)

(73) Assignee: Dolby International AB, Amsterdam (NL)

( * ) Notice: Subject to any disclaimer, the term of this patent is extended or adjusted under 35 U.S.C. 154(b) by 136 days.

(21) Appl. No.: 14/112,537

(22) PCT Filed: Apr. 27, 2012

(86) PCT No.: PCT/EP2012/057856

§ 371 (c)(1), (2), (4) Date: Oct. 17, 2013

(87) PCT Pub. No.: WO2012/146757

PCT Pub. Date: Nov. 1, 2012

(65) Prior Publication Data

US 2014/0039890 A1 Feb. 6, 2014

Related U.S. Application Data

(60) Provisional application No. 61/480,215, filed on Apr. 28, 2011.

(51) Int. Cl.
*G10L 19/00* (2013.01)
*G10L 25/93* (2013.01)
(Continued)

(52) U.S. Cl.
CPC ..... *G10L 25/93* (2013.01); *G10L 19/167* (2013.01); *G10L 19/24* (2013.01); *G10L 2025/783* (2013.01)

(58) Field of Classification Search
CPC ..... G10L 19/00
USPC ..... 704/500
See application file for complete search history.

(56) References Cited

U.S. PATENT DOCUMENTS 7,454,331 B2 * 11/2008 Vinton et al. ..... 704/225
2005/0080619 A1 * 4/2005 Choi et al. ..... 704/215
(Continued)

FOREIGN PATENT DOCUMENTS

CN 1424712 6/2003
CN 101246686 8/2008
(Continued)

OTHER PUBLICATIONS

ISO/IEC 14496-3 "Information Technology—Coding of Audio Visual Objects—Part 3: Audio" published on Aug. 26, 2009.
(Continued)

*Primary Examiner* — Jialong He

(57) ABSTRACT

Efficient Context Classification and Gated Loudness Estimation The present document relates to methods and systems for encoding an audio signal. The method comprises determining a spectral representation of the audio signal. The determining a spectral representation step may comprise determining modified discrete cosine transform, MDCT, coefficients, or a Quadrature Mirror Filter, QMF, filter bank representation of the audio signal. The method further comprises encoding the audio signal using the determined spectral representation; and classifying parts of the audio signal to be speech or non-speech based on the determined spectral representation. Finally, a loudness measure for the audio signal based on the speech parts is determined.

7 Claims, 6 Drawing Sheets

(51) Int. Cl.

| | |
|---|---|
| ***G10L 19/16*** | (2013.01) |
| ***G10L 19/24*** | (2013.01) |
| *G10L 25/78* | (2013.01) |

(56) References Cited

U.S. PATENT DOCUMENTS

| | | | | |
|---|---|---|---|---|
| 2007/0253481 | A1* | 11/2007 | Oshikiri | 375/240.12 |
| 2007/0291959 | A1* | 12/2007 | Seefeldt | 381/104 |
| 2009/0067644 | A1* | 3/2009 | Crockett et al. | 381/98 |
| 2009/0097676 | A1* | 4/2009 | Seefeldt | 381/107 |
| 2009/0304190 | A1* | 12/2009 | Seefeldt et al. | 381/56 |
| 2011/0257982 | A1* | 10/2011 | Smithers | 704/500 |

FOREIGN PATENT DOCUMENTS

| | | |
|---|---|---|
| EP | 2 002 426 | 3/2007 |
| JP | 2001-154698 | 6/2001 |
| JP | 2002-116784 | 4/2002 |
| JP | 2006-501502 | 1/2006 |
| JP | 2007-272118 | 10/2007 |
| JP | 2010-508550 | 3/2010 |
| JP | 2010-169766 | 8/2010 |
| WO | 2006/037366 | 4/2006 |
| WO | 2006/113047 | 10/2006 |
| WO | 2010/075377 | 7/2010 |
| WO | 2010/131470 | 11/2010 |
| WO | 2011/051279 | 5/2011 |

OTHER PUBLICATIONS

Daudet, L. et al. "MDCT Analysis of Sinusoids: Exact Results and Applications to Coding Artifacts Reduction" IEEE Transactions on Speech and Audio Processing, vol. 12, No. 3, May 2004, pp. 302-312.

Freund, Y. et al. "A Short Introduction to Boosting" Journal of Japanese Society for Artificial Intelligence, 14(5), pp. 771-780, 1999.

Kiranyaz, S. et al "A Generic Audio Classification and Segmentation Approach for Multimedia Indexing and Retrieval" IEEE Transactions on Audio, Speech, and Language Processing, vol. 14, No. 3, May 2006, pp. 1062-1081.

Pfeiffer, S. et al "Formalisation of MPEG-1 Compressed Domain Audio Features" CSIRO Mathematical and Information Sciences, Dec. 18, 2001, Report No. 01/196.

Ravelli, E. et al. "Audio Signal Representations for Indexing in the Transform Domain" IEEE Transactions on Audio, Speech, and Language Processing, vol. 18, Issue 3, published in 2010, pp. 434-446.

Robinson Charlie et al "Automated Speech/Other Discrimination for Loudness Monitoring" AES Conventiion, 118, May 2005, AES, New York, USA.

ATSC: "ATSC Standard: Digital Audio Compression (AC-3), Revision A, Doc A/52A", Aug. 20, 2001, pp. 1-140.

Xu, H et al. "Low-Delay Cosine-Modulated QMF Bank for MPEG Audio Compression" 1996 IEEE International Symposium on Circuits and Systems, May 12-15, 1996, pp. 340-343.

Brandenburg, K "MP3 and AAC Explained" Proceedings of the International AES Conference, Jan. 1, 1999, pp. 99-110.

Riedmiller, J et al. "Practical Program Loudness Measurement for Effective Loudness Control" AES Convention May 2005, AES, New York, USA.

Friedrich, T. et al "A Fast Feature Extraction System on Compressed Audio Data" AES Convention 124, May 2008, AES, New York, USA.

Shao, Xi et al. "Automatic Music Summarization in Compressed Domain" Acoustics, Speech, and Signal Processing, 2004 IEEE, May 17-21, 2004, Piscataway, NJ, USA, vol. 4.

ITU "Recommendation ITU-R BS, 1770-1 Algorithm to Measure Audio Programme Loudness and True-Peak Audio Level", Jan. 1, 2006, pp. 1-19.

Robinson, David "Replay Gain Proposal" published on Jul. 10, 2001.

* cited by examiner

EFFICIENT CONTENT CLASSIFICATION AND LOUDNESS ESTIMATION

TECHNICAL FIELD

The present document relates to methods and systems for efficient content classification and loudness estimation of audio signals. In particular, it relates to efficient content classification and gated loudness estimation within an audio encoder.

BACKGROUND

Portable handheld devices, e.g. PDAs, smart phones, mobile phones, and portable media players, typically comprise audio and/or video rendering capabilities and have become important entertainment platforms. This development is pushed forward by the growing penetration of wireless or wireline transmission capabilities into such devices. Due to the support of media transmission and/or storage protocols, such as the High-Efficiency Advanced Audio Coding (HE-AAC) format, media content can be continuously downloaded and stored onto the portable handheld devices, thereby providing a virtually unlimited amount of media content.

HE-AAC is a lossy data compression scheme for digital audio defined as MPEG-4 Audio profile in ISO/IEC 14496-3. It is an extension of Low Complexity AAC (AAC LC) optimized for low-bitrate applications such as streaming audio. HE-AAC version 1 profile (HE-AAC v1) uses spectral band replication (SBR) to enhance the compression efficiency in the frequency domain. HE-AAC version 2 profile (HE-AAC v2) couples SBR with Parametric Stereo (PS) to enhance the compression efficiency of stereo signals. It is a standardized and improved version of the AACplus codec.

With the introduction of digital broadcast, the concept of time-varying-metadata which enables to control gain values at the receiving end in order to tailor content to a specific listening environment was established. An example is the metadata included in Dolby Digital which includes general loudness normalization information ("dialnorm") for dialogues. It should be noted that throughout this specification and in the claims, references to Dolby Digital shall be understood to encompass both the Dolby Digital and Dolby Digital Plus coding systems.

One possibility to assure consistency of loudness levels across different content types and media formats is loudness normalization. A prerequisite for loudness normalization is the estimation of the signal loudness. One approach to loudness estimation has been proposed in the ITU-R BS.1770-1 recommendation.

The ITU-R BS.1770-1 recommendation is an approach to measure the loudness of a digital audio file, while taking a psychoacoustic model of the human hearing into account. It proposes to preprocess the audio signal of each channel with a filter for modeling head effects and a high-pass filter. Then, the power of the filtered signal is estimated over the measurement interval. For multichannel audio signals the loudness is calculated as the logarithm of the weighted sum of the estimated power values of all channels.

One drawback of the ITU-R BS.1770-1 recommendation is that all signal types are handled equally. A long period of silence would lower the loudness result; however this silence may not affect the subjective loudness impressions. An example for such a pause could be the silence between two songs.

A simple, yet effective method to work around this problem is to only take, subjectively significant, parts of the signal into account. This method is called gating. The significance of signal parts may be determined based on a minimum energy, a loudness level threshold or other criteria. Examples for different gating methods are silence gating, adaptive threshold gating, and speech gating.

For gating, a Discrete Fourier Transform (DFT) and other operations on the audio signal are typically performed. However, this causes additional processing effort which is undesirable. Furthermore, the classification of audio signals into different classes for gating the loudness calculation is typically imperfect, thus resulting in misclassifications impacting the loudness calculation.

Accordingly, there is a need for improved audio classification to enhance gating and loudness calculation. Furthermore, it is desired to reduce the computational effort in gating.

SUMMARY

The present application relates to the detection of speech/non-speech segments in digital audio signals. The detection results may be used in calculating a loudness level value for a digital audio signal. Typically, speech/non-speech segment detection relies on the aggregation of multiple features which are extracted from the digital audio signal. In other words, a multitude of criteria is used in order to decide whether a digital audio signal segment is a speech or a non-speech segment.

Typically, at least some of these features are based on calculating the spectrum of the segments. For calculating the spectrum, a DFT may be used which places a high computational burden on the encoding system. However, recent research has shown that the explicit calculation of the spectrum using a DFT can be avoided for example by using Modified Discrete Cosine Transform (MDCT) data instead. I.e. the MDCT coefficients can be used for determining features that are based on calculating the spectrum of the digital audio signal segments. This is especially advantageous in the context of digital audio signal encoders that produce MDCT data while encoding a digital audio signal. In this case, MDCT data from the encoding scheme may be used for speech/non-speech detection thereby avoiding a DFT of the digital audio signal segments. By this, overall computational complexity can be reduced since the already available MDCT data is reused which renders a DFT on the digital audio signal segments superfluous. It should be noted that although in the example above, the MDCT data can be advantageously used for avoiding a DFT of the digital audio signal segments, any transform representation in an encoder may be used as spectral representation. Accordingly, the transform representation may, for instance, be MDST (Modified Discrete Sine Transform) or real or imaginary parts of MLT (Modified Lapped Transform). Furthermore, the spectral representation may comprise a Quadrature Mirror Filter, QMF, filter bank representation of the audio signal.

In the case that the encoding scheme produces scalefactor band energies, the scalefactor band energies may be used for the determination of features which are based on the spectral tilt. Furthermore, if the encoding scheme produces energy values for segments of the digital audio signal, e.g. for one or multiple blocks, energy features which are based on the energy of the segments in the time domain may use this information instead of explicitly calculating the energy themselves.

Even further, if spectral band replication (SBR) data is available, SBR payload quantity may be advantageously used as an indication of signal onsets, and the signal classification into speech/non-speech may be based on a processed version of SBR payload quantity which provides rhythmic information. Hence, already available SBR date may be further exploited for determining a rhythm based feature for the detection of speech/non-speech segments in digital audio signals.

Generally speaking, the proposed reuse of information as further detailed in the following reduces the overall computational complexity of the system and hence provides a synergistic effect.

According to an aspect, a method for encoding an audio signal is described. The method comprises determining a spectral representation of the audio signal. The determining a spectral representation may comprise determining modified discrete cosine transform, MDCT, coefficients. In general, any transform representation in an encoder can be used as spectral representation. The transform representation may, for instance, be MDST (Modified Discrete Sine Transform) or real or imaginary parts of MLT (Modified Lapped Transform). Furthermore, the spectral representation may comprise a Quadrature Mirror Filter, QMF, filter bank representation of the audio signal.

The method further comprises encoding the audio signal using the determined spectral representation. Parts of the audio signal may be classified to be speech or non-speech based on the determined spectral representation, and a loudness measure for the audio signal may be determined based on the classified speech parts, ignoring the identified non-speech parts. Thus, a gated loudness measure concentrated on the speech parts of the audio signal is determined from the spectral representation that is also used for encoding the audio signal. No separate spectral representation of the audio signal is computed for the loudness estimation; hence the computational effort in the encoder for the calculation of the gated loudness measure is reduced.

The method may further comprise determining a pseudo spectrum from the MDCT coefficients. The classification of speech/non-speech parts may be based at least in part on the values of the determined pseudo spectrum. The pseudo spectrum derived from the MDCT coefficients can be used as an approximation to the DFT spectrum that is normally used for the classification of speech parts in loudness estimation. Alternatively, the MDCT coefficients may be used directly as features for the speech/non-speech classification.

The method may further comprise determining a spectral flux variance. The classification of speech/non-speech parts may be based at least in part on the determined spectral flux variance because it has been shown that the spectral flux variance is a good feature for speech/non-speech classification. The spectral flux variance may be determined from the pseudo spectrum. Also, the spectral flux variance may be determined from the MDCT coefficients and proved to be a useful classification feature.

The method may further comprise determining scalefactor band energies from the MDCT coefficients. The classification of speech/non-speech parts may be based at least in part on the determined scalefactor band energies. Scalefactor band energies are typically used in the encoder for encoding the audio signal. Here, scalefactor band energies are suggested as features for classification of speech/non-speech parts of the audio signal.

The method may further comprise determining an average spectral tilt from the scalefactor band energies. The classification of speech/non-speech parts may be based at least in part on the average spectral tilt. Thus, it is proposed to calculate the average spectral tilt feature used for classification of speech based on scalefactor band energies, which is a very effective way of calculation and does not require the computation of an additional spectral signal representation.

The method may further comprise determining energy values for blocks of the audio signal. The method may continue by determining transients in the audio signal based on the block energies and in response determine coding block lengths for the audio signal. In addition, energy based features are determined based on the block energies. The classification of speech/non-speech parts may be based at least in part on the energy based features. Hence, the energy values calculated in the encoder for the purpose of deciding the appropriate block size for encoding the audio signal (block switching) are used directly in the computation of energy based classification features, such as a pause count metric, short and long rhythmic measures, etc.

The classification of speech/non-speech parts may be based on a machine learning algorithm, in particular the AdaBoost algorithm. Of course, other machine learning algorithms such as neural networks can be used as well.

The method may further comprise training of the machine learning algorithm based on speech data and non-speech data, thereby adjusting parameters of the machine learning algorithm so as to minimize an error function. During the training, the machine learning algorithm learns the importance of the individual features, such as for example the spectral flux or the average spectral tilt, and adapts its internal weights used for assessing the features during classification.

The spectral representation may be determined for short blocks and/or long blocks. Many encoders such as the AAC encoder use different block lengths for encoding the audio signal and have the ability to switch between the different block lengths based on the input signal so as to adjust the block lengths to the properties of the input signal. The method may further comprise aligning the short block representation with frames for a long block representation corresponding to a predetermined number of short blocks, thereby reordering MDCT coefficients of the predetermined number of short blocks into a frame for a long block. In other words, short blocks are converted into long blocks. This may be beneficial because subsequent modules for classification and loudness calculation need only process one block type. In addition, it allows a fixed time structure based on long blocks in the calculation for classification and loudness.

In case the spectral representation comprises a Quadrature Mirror filter bank representation of the audio signal, the method may further comprise encoding spectral band replication parameters for the audio signal using the determined spectral representation and classifying parts of the audio signal to be speech or non-speech based on the determined spectral representation. Then, a gated loudness measure for the audio signal based on the speech parts may be determined. Similar to above, this allows a gated loudness calculation based on a spectral representation that is also used for encoding the audio signal, here for encoding a high frequency part of the signal based on high frequency reconstruction or spectral band replication techniques.

The method may further comprise encoding the audio signal using the determined spectral representation into a bitstream and encoding the determined loudness measure into the bit-stream. Thus, a encoder is described that efficiently calculates and encodes a loudness measure such as dialnorm or program reference level together with the audio signal.

The audio signal may be a multi-channel signal, and the method may further comprise downmixing the multi-channel audio signal and performing the classification step on the downmixed signal. This allows making the calculations for signal classification and/or loudness measuring based on a mono signal.

The method may further comprise downsampling the audio signal and performing the classification step on the downsampled signal. Thus, making the calculations for signal classification and/or loudness measuring based on a downsampled signal further reduces the required computational effort.

According to another aspect, systems are disclosed which perform the above described methods, in particular an audio encoder for encoding the audio signal into a bit-stream. The audio signal may be encoded according to one of HE-AAC, MP3, AAC, Dolby Digital or Dolby Digital Plus, or any other codec based on AAC, or any other codec based on transformations mentioned above.

The system may include a MDCT calculation unit for determining a spectral representation of the audio signal based on modified discrete cosine transform, MDCT, coefficients and/or a SBR calculation unit including a Quadrature Mirror Filter, QMF, filter bank to determine a spectral representation for spectral band replication or high frequency reconstruction.

According to an aspect, a method for classifying speech parts of an audio signal is described. The audio signal may comprise a speech signal and/or other non-speech signals. The classification is to determine whether the audio signal is speech and/or which parts of the audio signal are speech signals. This classification may beneficially be used in the calculation of a gated loudness measure for the audio signal. Since spectral band replication (SBR) payload is a good indication of signal onsets, the signal classification may be based on a processed version of SBR payload that provides rhythmic information.

The method may comprise the step of determining a payload quantity associated with the amount of spectral band replication data for a time interval of the audio signal. Spectral band replication payload quantity can be used as an indicator for changes in the audio signal spectrum and, hence, provides rhythmic information.

The payload quantity may include SBR envelope data, time/frequency (T/F) grid data, tonal component data, and noise-floor data, or any combination thereof. In particular, any combination of these components along with the SBR envelope data is also possible.

Typically the payload quantity determining step is performed during encoding of the audio signal when determining spectral band replication data for the audio signal. In this case, the payload quantity associated with the amount of spectral band replication data can be received directly from the spectral band replication component of the encoder. The spectral band replication payload quantity may indicate the amount of spectral band replication data generated by the spectral band replication component for a time interval of the audio signal. In other words, the payload quantity indicates the amount of spectral band replication data for the time interval that is to be included in an encoded bit-stream.

The audio signal including the generated spectral band replication data is preferably encoded in the bit-stream for storage or transmission. The encoded bit-stream may be an HE-AAC bit-stream or an mp3PRO bit-stream, for instance. Other bit-stream formats are possible as well and within the reach of the skilled person.

The method may comprise the further step of repeating the above determining step for successive time intervals of the audio signal, thereby determining a sequence of payload quantities.

In a further step, the method may identify a periodicity in the sequence of payload quantities. This may be done by identifying a periodicity of peaks or recurring patterns in the sequence of payload quantities. The identification of periodicities may be done by performing spectral analysis on the sequence of payload quantities yielding a set of power values and corresponding frequencies. A periodicity may be identified in the sequence of payload quantities by determining a relative maximum in the set of power values and by selecting the periodicity as the corresponding frequency. In an embodiment, an absolute maximum is determined.

The spectral analysis is typically performed along the time axis of the sequence of payload quantities. Furthermore, the spectral analysis is typically performed on a plurality of sub-sequences of the sequence of payload quantities thereby yielding a plurality of sets of power values. By way of example, the sub-sequences may cover a certain length of the audio signal, e.g. 2 seconds. Furthermore, the sub-sequences may overlap each other, e.g. by 50%. As such, a plurality of sets of power values may be obtained, wherein each set of power values corresponds to a certain excerpt of the audio signal. An overall set of power values for the complete audio signal may be obtained by averaging the plurality of sets of power values. It should be understood that the term "averaging" covers various types of mathematical operations, such as calculating a mean value or determining a median value. I.e. an overall set of power values may be obtained by calculating the set of mean power values or the set of median power values of the plurality of sets of power values. In an embodiment, performing spectral analysis comprises performing a frequency transform, such as a Fourier Transform (FT) or a Fast Fourier Transform (FFT).

The sets of power values may be submitted to further processing. In an embodiment, the set of power values is multiplied with weights associated with the human perceptual preference of their corresponding frequencies. By way of example, such perceptual weights may emphasize frequencies which correspond to tempi that are detected more frequently by a human, while frequencies which correspond to tempi that are detected less frequently by a human are attenuated.

Next, the method may include the step of classifying at least a part of the audio signal to include speech or non-speech signals. The classification is preferably based on the extracted rhythmic information. The extracted rhythmic information may be used as a feature, possibly together with other features, in any kind of classifier to make the speech/non-speech decision for parts of the audio signal.

The speech/non-speech classification may then be used for the calculation of a gated loudness of the audio signal, the calculation of the loudness being restricted to speech parts of the audio signal. Thus, a more perceptually accurate loudness is provided which only considers the perceptually relevant speech parts of the audio signal and ignores non-speech parts. The loudness data may be included into the encoded bit-stream.

The method may comprise the step of providing a loudness value for the audio signal. A loudness related value may also be referred to as leveling information. A procedure or algorithm for determining the loudness value may be a set of manipulations of the audio signal in order to determine a loudness related value which represents the perceptual loudness, i.e. the perceived energy, of an audio signal. Such procedure or algorithm may be the ITU-R BS.1770-1 algorithm to measure audio program loudness and/or the Replay Gain loudness calculation scheme. In an embodiment, the loudness is determined according to the ITU-R BS.1770-1 algorithm ignoring silence and/or non-speech periods of the audio signal.

The classification may use the rhythmic information extracted from SBR payload as a feature in a machine learning algorithm such as the AdaBoost algorithm to distinguish speech signals from non-speech signals. Of course, other machine learning algorithms such as neural networks may be used as well. In order to make most use of the rhythmic information, the classifier is trained on training data to distinguish speech signals from non-speech signals. The classifier may use the extracted rhythmic information as an input signal for classification and adapt its internal parameters (e.g. weights) so as to reduce an error measure on the training data. The proposed rhythmic information may be used by the classifier together with other features, such as the "classical" features used in an HE-AAC encoder. The machine learning algorithm may determine weights to combine the features offered for classification.

In an embodiment, the audio signal is represented by a sequence of succeeding subband coefficient blocks along a time axis. Such subband coefficients may e.g. be MDCT coefficients as in the case of the MP3, AAC, HE-AAC, Dolby Digital, and Dolby Digital Plus codecs.

In an embodiment, the audio signal is represented by an encoded bit-stream comprising spectral band replication data and a plurality of succeeding frames along a time axis. By way of example, the encoded bit-stream may be an HE-AAC or an mp3PRO bit-stream.

The method may comprise the step of storing the loudness related value in metadata associated with the audio signal. The metadata may have a pre-determined syntax or format. In an embodiment, the pre-determined format uses the Replay Gain syntax. Alternatively or in addition, the pre-determined format may be compliant with iTunes-style metadata or ID3v2 tags. In another embodiment, the loudness related value may be transmitted in a Dolby Pulse or HE-AAC bit-stream as a Fill Element, e.g. as a "program reference level" parameter, according to the MPEG standard ISO 14496-3.

The method may comprise the step of providing the metadata to a media player. The metadata may be provided along with the audio signal. In an embodiment, the audio signal and the metadata may be stored in one or more files. The files may be stored on a storage medium, e.g. random access memory (RAM) or compact disk. In an embodiment, the audio signal and the metadata may be transmitted to the media player, e.g. within a media bit-stream such as HE-AAC.

According to a further aspect, a software program is described, which is adapted for execution on a processor and for performing the method steps outlined in the present document when carried out on a computing device.

According to another aspect, a storage medium is described, which comprises a software program adapted for execution on a processor and for performing the method steps outlined in the present document when carried out on a computing device.

According to another aspect, a computer program product is described which comprises executable instructions for performing the methods outlined in the present document when executed on a computer.

According to another aspect, a system configured to classify speech parts of an audio signal is described. The system may comprise means for determining a payload quantity associated with an amount of spectral band replication data for a time interval of the audio signal; means for repeating the determining step for successive time intervals of the audio signal, thereby determining a sequence of payload quantities; means for identifying a periodicity in the sequence of payload quantities; and/or means for extracting rhythmic information of the audio signal from the identified periodicity. The system may further comprise means for classifying at least a part of the audio signal to include speech or non-speech based on the extracted rhythmic information. In addition, means for determining loudness data for the audio signal based on the classification of the audio signal in speech and non-speech parts are provided. In particular, the determining of loudness data may be limited to speech parts of the audio signal as identified by the classification means.

According to another aspect, a method for generating an encoded bit-stream comprising metadata of an audio signal is described. The method may comprise the step of encoding the audio signal into a sequence of payload data, thereby yielding the encoded bit-stream. By way of example, the audio signal may be encoded into an HE-AAC, MP3, AAC, Dolby Digital or Dolby Digital Plus bit-stream. The method may comprise the steps of determining metadata associated with a loudness of the audio signal and inserting the metadata into the encoded bit-stream. Preferably, the loudness data is determined only on speech parts of the audio signal as determined by a classifier based on rhythmic information for the audio signal. It should be noted that the rhythmic information for the audio signal may be determined according to any of the methods outlined in the present document.

According to a further aspect, an encoded bit-stream of an audio signal comprising metadata is described. The encoded bit-stream may be an HE-AAC, MP3, AAC, Dolby Digital or Dolby Digital Plus bit-stream. The metadata may comprise data representing a gated loudness measure for the audio signal, the gated loudness measure derived from speech portions of the audio signal by any of the classifiers outlined in the present document.

According to another aspect, an audio encoder configured to generate an encoded bit-stream comprising metadata of an audio signal is described. The encoder may comprise means for encoding the audio signal into a sequence of payload data, thereby yielding the encoded bit-stream; means for determining loudness metadata for the audio signal; and means for inserting the metadata into the encoded bit-stream. In a similar manner to the methods outlined above, the encoder may rely on spectral band replication data calculated for the audio signal (in particular the amount of payload for the spectral band replication data that is inserted into the bit-stream) as a basis for determining rhythmic information for the audio signal. The rhythmic information may then be used to classify the audio signal into speech and non-speech parts to gate the loudness estimation.

It should be noted that according to a further aspect, a corresponding method for decoding an encoded bit-stream of an audio signal and a corresponding decoder configured to decode an encoded bit-stream of an audio signal is described. The method and the decoder are configured to extract the respective metadata, notably the metadata associated with rhythmic information, from the encoded bit-stream.

A preliminary complexity analysis has shown that the potential complexity reduction of the proposed speech/non-speech classification over the prior art is significant. According to a theoretical approach assuming that the proposed implementation does not need a resampler and does not use a separate spectral analysis, the savings are up to 98%.

It should be noted that the embodiments and aspects described in this document may be combined in many different ways. In particular, it should be noted that the aspects and features outlined in the context of a system are also applicable in the context of the corresponding method and vice versa.

Furthermore, it should be noted that the disclosure of the present document also covers other claim combinations than the claim combinations which are explicitly given by the back references in the dependent claims, i.e., the claims and their technical features can be combined in any order and any formation.

BRIEF DESCRIPTION OF THE DRAWINGS

The present invention will now be described by way of illustrative examples, not limiting the scope or spirit of the invention, with reference to the accompanying drawings, in which.

DETAILED DESCRIPTION

Figure 1:
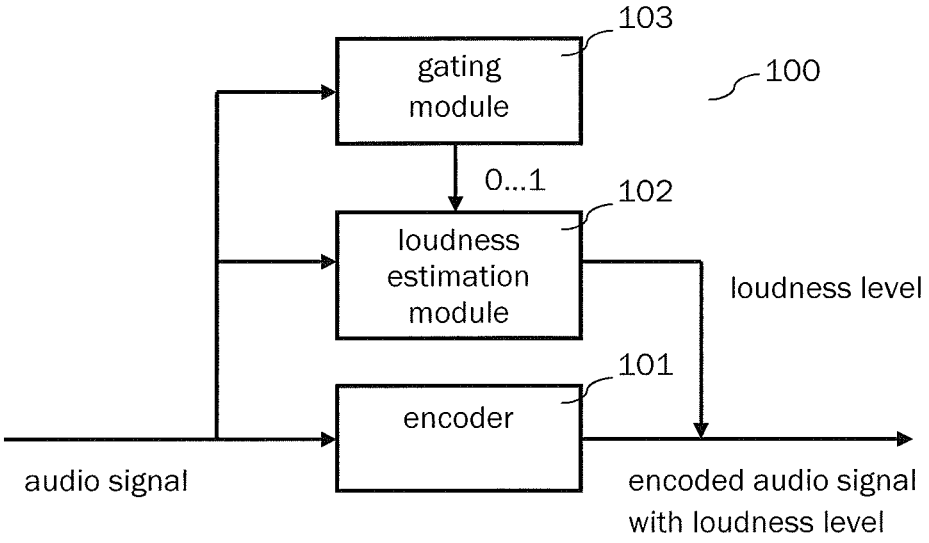
FIG. 1 schematically illustrates a system for producing an encoded output audio signal with loudness level information from an input audio signal.

The below-described embodiments are merely illustrative for the principles of methods and systems for rhythmic feature extraction, speech classification and loudness estimation. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

An approach to providing audio output at a constant perceived level is to define a target output level at which the audio content is to be rendered. Such a target output level may e.g. be −11 dBFS (decibels relative to Full Scale). In particular, the target output level may depend on the current listening environment. Furthermore, the actual loudness level of the audio content, also referred to as the reference level, may be determined. The loudness level is preferably provided along with the media content, e.g. as metadata provided in conjunction with the media content. In order to render the audio content at the target output level a matching gain value may be applied during playback. The matching gain value may be determined as the difference between the target output level and the actual loudness level.

As has already been indicated above, systems for streaming and broadcasting, like e.g. Dolby Digital, typically rely on transmitting metadata which comprises a "dialnorm" value which indicates the loudness level of the current program to the decoding device. The "dialnorm" value is typically different for different programs. In view of the fact that the "dialnorm" value or values are determined at the encoder, the content owner is enabled to control the complete signal chain up to the actual decoder. Furthermore, the computational complexity on the decoding device can be reduced, as it is not required to determine loudness values for the current program at the decoder. Instead the loudness values are provided in the metadata associated with the current program.

The inclusion of metadata along with audio signals has allowed for significant improvements in the user listening experience. For a pleasant user experience, it is generally desirable for the general sound level or loudness of different programs to be consistent. However, the audio signals of different programs usually originate from different sources, are mastered by different producers and may contain diverse content ranging from speech dialog to music to movie soundtracks with low-frequency effects. This possibility for variance in the sound level makes it a challenge to maintain the same general sound level across such a variety of programs during playback. In practical terms, it is undesirable for the listener to feel the need to adjust the playback volume when switching from one program to another in order to adjust one program to be louder or quieter with respect to another program because of differences in the perceived sound level of the different programs. Techniques to alter the audio signals in order to maintain a consistent sound level between programs are generally known as signal levelling. In the context of dialog audio tracks, a measure relating to the perceived sound level is known as the dialog level, which is based on an average weighted level of the audio signal. Dialog level is often specified using a "dialnorm" parameter, which indicates a level in decibels (dB) with respect to digital full scale.

Within audio coding a number of metadata types evolved in codecs like AC-3 or HE-AAC, including dynamic range compression and loudness description. AC-3, for instance, uses a value called "dialnorm" to provide loudness information of the encoded audio signal. In HE-AAC the equivalent value is called "program reference level", which is included in the data stream element. The playback device reads the loudness value and adjusts the output signal by the gain factor accordingly. This way the original audio signal is not changed. The metadata model is therefore called non-destructive.

In the following, methods for classifying an audio signal into speech and non-speech parts are described. This classification may then be used to gate the calculation of a loudness estimate, such as according to the ITU-R recommendation BS.1770-1, which document is incorporated by reference. The loudness calculation can then be concentrated on audio parts containing speech content, e.g. to determine a "dialnorm" value for insertion into an encoded bit-stream, such as according to the HE-AAC format. On the one hand, the classification of audio should be as correct as possible to achieve a good loudness estimate. On the other hand, the loudness calculation and in particular the speech/non-speech classification should be efficient and put as little computational load on the encoder as possible. Hence, according to an aspect of the present document, it is proposed to integrate the loudness calculation and in particular the speech/non-speech classification into the encoder operation and make use of existing calculations and already produced data instead of recalculating similar values for the loudness estimation.

As already mentioned, it is beneficial to limit the calculation of a loudness estimate to speech parts of the audio signal. Some of the following characteristics of speech are crucial to distinguish from other signal types. Speech is a composition of voiced and unvoiced parts, also known as frictional noise and vowels. Frictional noise can be separated into two subcategories. Sounds like 'k' and 't' are very transient whereas sounds like 's' and 'f' have noise like spectra. The voiced and unvoiced parts of speech, together with short breaks in between words and sentences, result in a constantly varying spectrum of the audio signal. Music on the other hand has a much slower and rather small fluctuation in the spectrum. Looking at the spectral magnitude of the signal one can also observe very short parts with low energy. These short breaks are an indicator for speech content.

As a consequence of the relevance of speech content in the signal for perception, it is proposed to recognize speech parts and compute the loudness only from these parts of the signal. This speech loudness value can be used in any of the described metadata types.

According to embodiments, a system for calculating a gated loudness measure has four components. The first component relates to signal pre-processing and contains a resampler and mixer. After downmixing a mono signal from the input signal, the signal is resampled at 16 kHz. The second component calculates 7 features covering different criteria of the signal, which are useful to identify speech. The 7 features can be categorized in two groups: spectral features like spectral flux, and time domain features like pause count and zero cross rate. The third component is a machine learning algorithm called AdaBoost which makes a binary decision based on the feature vector of the 7 features. Every feature is calculated based on the mono signal with a sampling rate of 16 kHz. The time resolution may be set individually for each feature to achieve the best possible results. Therefore, every feature may have its own block length. In this context, a block is a certain amount of time samples processed by the feature. The last component calculates a loudness measurement, running on the initial sampling rate, which is following the ITU-R recommendation. The loudness measurement is updated every 0.5 seconds with the current signals status (speech/other) from the classifier. Accordingly, it can compute the speech and overall loudness.

The above loudness measurement may be applied e.g. in the HE-AAC encoding schema which includes the AAC core encoder comprising a MDCT filter bank. A SBR encoder is used for lower bitrates and contains a QMF filter bank. According to an embodiment, the spectral representation provided by the MDCT filter bank and/or the QMF filter bank is used for signal classification. The speech/other classification may be placed in the AAC core, right after the MDCT filter bank. The time signal and the MDCT coefficients can be extracted there. This is also the place for the window switching, which is calculating the energy of the signal in blocks of 128 samples. The scalefactor bands, which contain the energy of a specific frequency band, may be used to estimate the needed accuracy for the quantization of the signal.

FIG. 1 schematically illustrates a system 100 for producing an encoded output audio signal with loudness level information from an input audio signal. The system comprises encoder 101 and loudness estimation module 102. Additionally, the system comprises a gating module 103.

Encoder 101 receives an audio signal from a signal source. For example, the signal source may be an electronic device storing audio data in a memory of the electronic device. The audio signal may comprise one or more channels. For example, the audio signal may be a mono audio signal, a stereo audio signal or a 5(0.1) channel audio signal. The audio signal may comprise speech, music, or any other type of audio signal content.

Furthermore, the audio signal may be stored in the memory of the electronic device in any suitable format. For example, the audio signal may be stored in a WAV, AIFF, AU or raw header-less PCM file. Alternatively, the audio signal may be stored in a FLAC, Monkey's Audio (filename extension APE), WavPack (filename extension WV), Shorten, TTA, ATRAC Advanced Lossless, Apple Lossless (filename extension m4a), MPEG-4 SLS, MPEG-4 ALS, MPEG-4 DST, Windows Media Audio Lossless (WMA Lossless), and SHN file. Even further, the audio signal may be stored in a MP3, Vorbis, Musepack, AAC, ATRAC and Windows Media Audio Lossy (WMA lossy) file.

The audio signal may be transmitted from the signal source to the system 100 over a wired or a wireless connection. Alternatively, the signal source may be part of the system, i.e. the system 100 may be hosted on a computer which also stores the audio file. The computer hosting the system 100 may be a desktop computer or a server which is connected to other computers over a wired or wireless network, e.g. the Internet or an Access Network.

Encoder 101 may encode the audio signal according to a specific encoding technique. The specific encoding technique may be DD+. Alternatively, the specific encoding technique may be Advanced Audio Coding (AAC). Even further, the specific encoding technique may be High Efficiency AAC (HE-AAC). The HE-AAC encoding technique may be based on the AAC encoding technique and a SBR encoding technique. The AAC encoding technique may be based at least in part on a MDCT filter bank. The SBR encoding technique may be based at least in part on a Quadrature Mirror Filter (QMF) filter bank.

Loudness estimation module 102 estimates the loudness of the audio signal according to a specific loudness estimation technique. The specific loudness estimation technique may follow the ITU-R BS.1770-1 recommendation. Alternatively, the specific loudness estimation technique may follow the Replay Gain proposal by David Robinson (see http://www.replaygain.org/). When the specific loudness estimation follows the ITU-R BS.1770-1 recommendation, the loudness may be estimated on the segments of the input audio signal that comprise content other than silence. For example, the loudness may be estimated on the segments of the input audio signal that comprise speech. Heretofore, loudness estimation module may receive a gating signal from gating module 103, the signal indicating whether the loudness estimation module should estimate the loudness on basis of a current audio input sample. For example, gating module 103 may provide, e.g. send, a signal to loudness estimation module 102, the signal indicating that a current sample or portion of the audio signal comprises speech. The signal may be a digital signal comprising a single bit. For example, if the bit is high, the signal may indicate that a current audio sample comprises speech and is to be processed by loudness estimation module 102 for estimating the loudness of the audio input signal. If the bit is low, the signal may indicate that a current audio signal does not comprise speech and is not to be processed by loudness estimation module 102 for estimating the loudness of the audio input signal.

Figure 2:
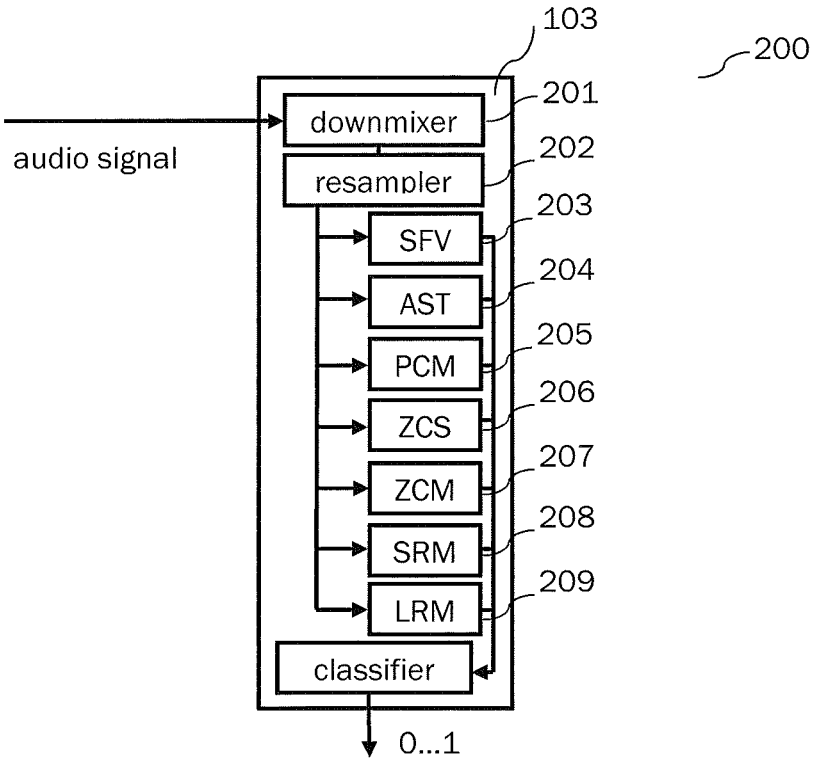
FIG. 2 schematically illustrates a system for estimating loudness level information from an input audio signal.

Gating module 103 classifies the input audio signal in different content categories. For example, gating module 103 may classify the input audio signal in non-silence and silence, or in speech and non-speech segments. For classifying the input audio signal into speech and non-speech segments, gating module 103 may employ various techniques as shown in FIG. 2 which schematically illustrates a system 200 for estimating loudness level information from an input audio signal. For example, gating module 103 may comprise one or more of the following submodules for calculation of features.

For the following discussion, the terms "feature", "block", and "frame" are briefly explained. A feature is a measure that derives certain characteristics from the signal which is able to indicate the presence of a particular class in the signal, e.g. speech parts in the signal. Every feature can operate in two processing levels. Short signal excerpts are processed in block units. A long term estimation of a feature is made in frames with a length of 2 seconds. A block is the amount of data that is used to compute low-level information of every feature. It holds either time samples or spectral data of the signal. In the following equations M is defined as the block size. A frame is a long term measure based on a certain amount of blocks. The update rate is typically 0.5 seconds with a time window of 2 seconds. In the following equations N is defined as the frame size.

Gating module 103 may comprise a Spectral Flux Variance (SFV) submodule 203. SFV submodule 203 works in the transform domain and is adapted to take the rapid change in the spectrum of speech signals into account. As a metric for the flux in the spectrum $F_1$ (t) is calculated as the average squared $l_2$ norm of the spectral flux for frame t (with M being the number of blocks in a frame):

$$F_1(t) = \sum_{m=0}^{M-1} (\|l_m\|)^2$$

SFV submodule 203 may calculate the weighted Euclidean distance $\|l_m\|$ between two blocks m and m−1

$$\|l_m\| = \sqrt{\sum_{k=0}^{\frac{N}{2}-1} \frac{|(X_{m-1}[k] - X_m[k])|^2}{W_m}}$$

with $W_m$ being the weight for block m $$W_m = \sum_{k=0}^{\frac{N}{2}-1} \frac{(|X_{m-1}[k]|^2 + |X_m[k]|^2)}{N}$$

wherein X[k] denotes the amplitude and phase of the complex spectrum at frequency 2πk/N.

Hence, to weight the spectral flux, the current and previous spectral energies are calculated. The $l_2$-norm, also called Euclidean distance, is calculated from the difference of the two spectral magnitudes. The weighting is necessary to remove dependency on the overall energy of the two blocks $X_m$ and $X_{m-1}$. The results that are passed to the boosting algorithm may be calculated from the 128 summed $l_2$-norm values.

Gating module 103 may comprise an Average Spectral Tilt (AST) submodule 204. The average spectral tilt works based on similar principles as described above, but only taking the tilt of the spectrum into account. Music usually contains mostly tonal parts, which leads to a negative tilt of the spectrum. Speech also contains tonal parts, but these are regularly intermittent with frictional noise. These noise-like signals lead to a positive slope due to low energy levels in the lower spectrum. For a signal part containing speech, a rapidly changing tilt can be observed. For other signal types, the tilt typically stays in the same range. As a metric $F_2$(t) for the AST in the spectrum, AST submodule 204 may calculate $$F_2(t) = \log\left(\left|\sum_{m=0}^{M-1}\left(G_m - \sum_{n=0}^{M-1}\frac{G_n}{M}\right)^3\right|\right)$$

-continued with $$G_m = \frac{\frac{N}{2}\sum_{k=0}^{\frac{N}{2}-1} kX_m^{dB}[k] - \sum_{k=0}^{\frac{N}{2}-1} k \cdot \sum_{k=0}^{\frac{N}{2}-1} X_m^{dB}[k]}{\frac{N}{2}\sum_{k=0}^{\frac{N}{2}-1} k^2 - \left(\sum_{k=0}^{\frac{N}{2}-1} k\right)^2}$$

where Gm is the regressive coefficient for block m.

The sum of the spectral power density in the log-domain is accumulated and compared with a weighted spectral power density. The conversion into the log-domain is according to $$X_m^{dB} = 10 \cdot \log_{10}(|X_m[k]|^2) \text{ for } 0 \le k < \frac{N}{2}$$

Gating module 103 may comprise a Pause Count Metric (PCM) submodule 205. PCM recognizes small breaks which are very characteristic for speech. The low-level part of the feature calculates the energy for N=128 samples/block. A value $F_3$(t) for the PCM may be determined by calculating the mean energy of the current frame and comparing the mean energy of each block $$P[m] = \sum_{n=0}^{N-1} \frac{x[n]^2}{N}$$

in the frame with the mean energy of the current frame. Is the block energy lower than 25% of the mean energy value of the current frame, it may be counted as pause and therefore the numerical value of $F_3$(t) may be incremented. Multiple consecutive blocks which fit under this criterion are only counted as one pause.

Gating module 103 may comprise a Zero Crossing Skew (ZCS) submodule 206. The Zero Crossing Skew relates to the zero crossing rate, i.e. the number of times, where the time signal crosses the zero line. It could also be described by how often a signal changes the sign in a given time frame. The ZCS is a good indicator for the presence of high frequencies in combination with only few low frequencies. The skew of a given frame is an indicator of rapid change in the signal value, which makes it possible to classify voiced speech versus unvoiced speech. A value $F_4$(t) for the ZCS may be determined by calculating $$F_4(t) = \frac{\sum_{m=0}^{M-1}\left(Z_m - \sum_{n=0}^{M-1}\frac{Z_n}{M}\right)^3}{\left(\sum_{m=0}^{M-1}\left(Z_m - \sum_{M-1}^{n=0}\frac{Z_n}{M}\right)^2\right)^{\frac{3}{2}}}$$

with $Z_m$ as zero crossing count in block m.

Gating module 103 may comprise a Zero Crossing Median to Mean Ratio (ZCM) submodule 207. This feature also takes a number of 128 zero crossing values and calculates the median to mean ratio. The median value is calculated by sorting all zero cross count blocks of the current frame. After that it takes the central point of the sorted array. Blocks with a high zero crossing rate do influence the mean value, but not the median. A value $F_5(t)$ for the ZCS may be determined by calculating $$F_5(t) = \frac{Z_{median}}{\sum_{m=0}^{M-1} \frac{Z_m}{M}}$$

with $Z_{median}$ being the median of the block zero crossing rates for all blocks in frame t.

Gating module 103 may comprise a Short Rythmic Measure (SRM) submodule 208. The previously mentioned features have difficulties with highly rhythmical music. For instance, HipHop and Techno music can lead to wrong classifications. These two genres have highly rhythmical parts, which can be easily detected with the SRM and LRM features. A value $F_6(t)$ for the SRM may be determined by calculating $$F_6(t) = \frac{max_{L \le n < M}\,(A_t[n])}{A_t[0]}$$

with $$A_t[l] = \frac{1}{M}\sum_{m=0} M - 1 - l\delta[m] \cdot \delta[m+l] \text{for } 0 \le l < M,$$

$$\delta[m] = \sigma_x^2[m] - \overline{\sigma}_x^2 \text{ for } 0 \le m < M$$

and $$\sigma_x^2[m] = \sum_{n=0}^{N-1} \frac{(x[n] - \overline{x}_m)^2}{N}$$

where d[m] is the element in the zero-mean sequence for block m and At[l] is the autocorrelation value for frame t with a block lag of l. The SRM calculates the autocorrelation for the current frame of variance blocks. Then, the highest index in the search range of $A_T$ is searched.

Gating module 103 may comprise a Long Rythmic Measure (LRM) submodule 209. A value $F_7(t)$ for the LRM may be determined by calculating an auto correlation of the energy envelope $$F_7(t) = \frac{\max_{LL \le 1M}\,(AL_t[n]}{AL_t[0]}$$

with $$AL_t[l] = \frac{1}{2M}\sum_{m=-M+1}^{M-1-l} W[m] \cdot W[m+l] \text{for } 0 \le l < 2M$$

$AL_t[l]$ being the autocorrelation score for frame t.

At least one of the features $F_1(t)$ to $F_7(t)$ may be used for classifying the input audio signal into speech and non-speech segments. If more than one of the features $F_1(t)$ to $F_7(t)$ is used, the values may be processed by a machine learning algorithm which may derive a binary decision out of the used features. The machine learning algorithm may be a further submodule in gating module 103. For example, the machine learning algorithm may be AdaBoost. The AdaBoost algorithm is described in: Yoav Freund and Robert E. Schapire, A short introduction to boosting, Journal of Japanese Society for Artificial Intelligence, 14(5), pages 771-780, 1999, which document is incorporated by reference.

AdaBoots may be used to boost a so called weak learning algorithm to a strong learning algorithm. Applied on the system described above, AdaBoost may be used to derive a binary decision out of the 7 values $F_1(t)$ to $F_7(t)$.

AdaBoost is trained on a database of examples. It may be trained by providing the correctly labeled output vector of the features as input. It then can provide a boosting vector for usage during the actual application of the AdaBoost as classifier. The boosting vector may be a set of thresholds and weights for each feature. It may provide the information, which feature votes for a speech or a non-speech decision, and weights it with the value established during the training.

The features extracted from the audio signal represent the "weak" learning algorithm. Each one of these "weak" learning algorithms is a simple classifier, which will then be compared with thresholds and factorized with given weights. The output is a binary classification, deciding whether the input audio is speech or not.

For example, the output vector may assume Y=−1, +1 for speech or non-speech. AdaBoost calls the weak learner multiple times in so called boosting rounds. It maintains a distribution of weights $D_t$, which will be higher ranked each time the weak hypothesis is wrongly classified. This way the hypothesis has to focus on the hard examples of the training set. The quality of the weak hypothesis can be calculated from the distribution $D_t$.

---

Boosting Training Give: $(x_1, y_1), \ldots, (x_m, y_m)$ where $x_i \in X$, $y_i \in Y = -1, +1$ Initialize $D_1(i) = \frac{1}{m}$ For t = 1, . . . , T:
Train weak learner using distribution $D_t$.
Get weak hypothesis $h_t: X \rightarrow -1, +1$ with error $$e_t = \Pr_{i\,D_t}[h_t(x_i) \neq y_i]$$

Choose $\alpha_t = \frac{1}{2}\ln\left(\frac{1-e_t}{e_t}\right)$

Update:

$$D_{t+1}(i) = \frac{D_t(i)}{Z_t} \times \begin{cases} e^{-\alpha_t} & \text{if } h_t(x_i) = y_i \\ e^{\alpha_t} & \text{if } h_t(x_i) \neq y_i \end{cases}$$

$$= \frac{D_t(i)\,\exp(-\alpha_t y_i h_t(x_i))}{Z_t}$$

Where $Z_t$ is a normalization factor (chosen so that $D_{t+1}$ will be a distribution).
Output the final hypothesis $$H(x) = \text{sign}\left(\sum_{t=1}^{T} \alpha_t h_t(x)\right)$$

---

After performing for example 20 rounds of boosting, the training algorithm will return a boosting vector. The number of boosting rounds is not fixed but may be empirically chosen, e.g. as 20. The effort to apply it, is compared to the employing of the vector with the previous described training, rather small. The algorithm is receiving a vector with 7 values, one for each $F_i(t)$. With each round, the algorithm iterates through the vector and takes one feature result, compares it to the threshold, and derives the meaning of it in form of the sign.

The following is example code for binary speech/other classification:

```
int boosting(float *inputVec, float *boostingVec);
{
    /* ... init variables ... */
    {...}

    for(round=0; round < 20; round++)
    {
        featureNr = boostingVec[1][round];
        sign      = boostingVec[2][round];
        threshold = boostingVec[3][round];
        weight    = boostingVec[4][round];
        featureValue = inputVec[featureNr];

        tmp       = sign + getSign(featureValue – threshold);
        tmp       = sum * weight;
        sum      += tmp;
    }
    return(getSign(sum));
}
```

To train the encoder, a training database with speech excerpts and non-speech excerpts is encoded. Each of the excerpts has to be labeled in order to tell the training algorithm what the right decision would be. The encoder is then called with the training files as input. During the encoding process, every feature result is logged. The training algorithm is then applied to the input vectors. In order to test the results, a test database with different audio data is used. If the features work well, one can see that after each boosting round, the training and test error gets smaller. This error is computed from incorrectly classified input vectors.

The algorithm is choosing a threshold for each feature which results in a smallest possible error. After that, it may weight every wrong classified stump higher. In the next boosting round, the algorithm may choose another feature and a threshold with the smallest possible error. After some time the different stumps (examples/vectors) may not be weighted equally anymore. This means that everything, up to this point, every wrongly classified example may get more attention from the algorithm. This makes it possible to call a feature in a later boosting round again, with considering a new threshold due to the differently weighted distribution.

Figure 3:
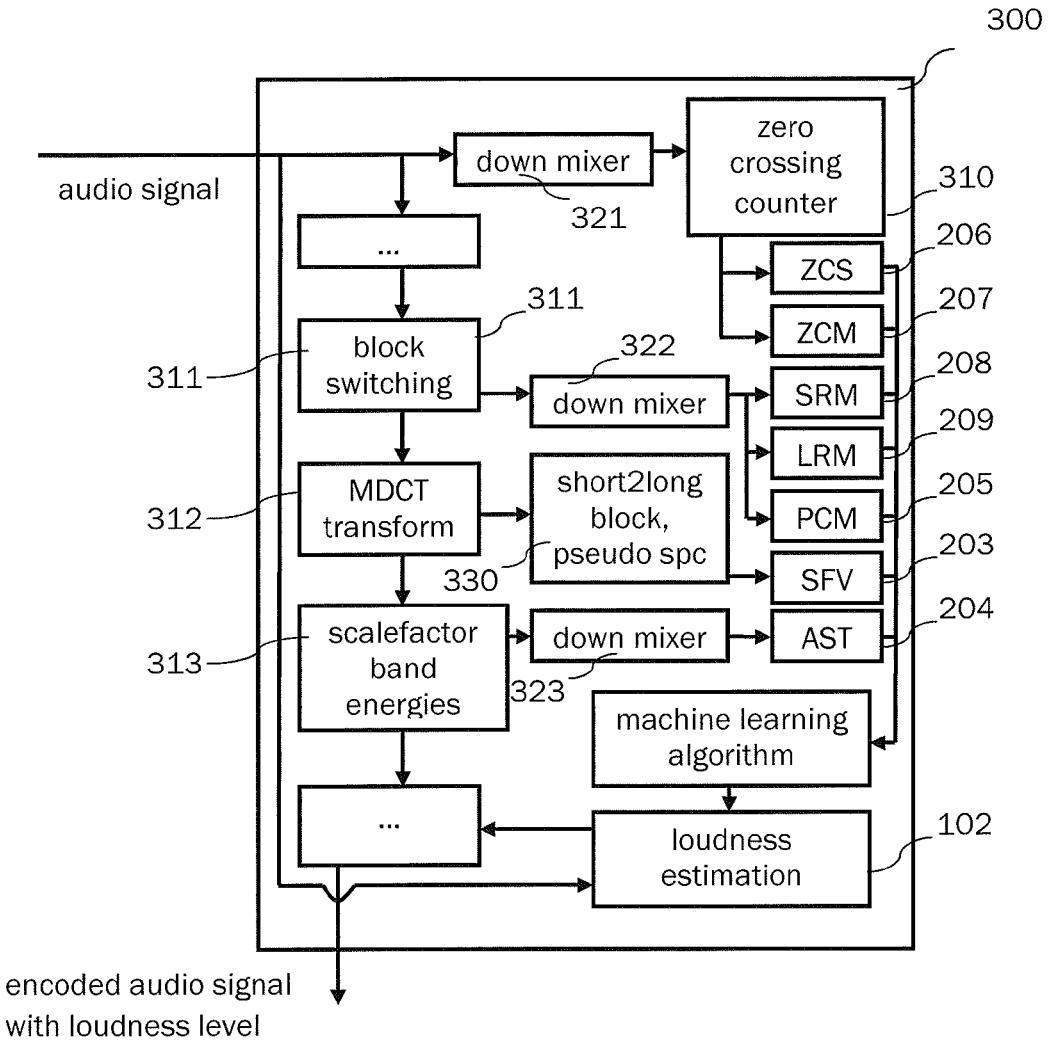
FIG. 3 schematically illustrates a system for estimating loudness level information from an input audio signal using information from an audio encoder.

FIG. 3 schematically illustrates a system 300 for estimating loudness level information from an input audio signal using information from an audio encoder.

System 300 comprises submodules of encoder 101, loudness estimation module 102 and gating module 103. For example, system 300 comprises at least one of the submodules 203 to 209 described with regard to FIG. 2. Furthermore, system 301 comprises at least one of block switching submodule 311, MDCT transform submodule 312, scalefactor band energies submodule 313 and further submodules. Furthermore, system 301 may comprise several downmixer submodules 321 to 223 if the audio input signal is a multichannel signal, and submodule 330 for shortblock handling and pseudo spectrum generation. If the audio input signal is a multichannel signal, submodule 330 may also comprise a downmixer.

Submodules 203 to 209 transmit their values $F_1(t)$ to $F_7(t)$ to loudness estimation module 102 which performs loudness estimation as described above. The loudness information of loudness estimation module 102, e.g. a loudness measure, may be encoded into the bit stream carrying the encoded audio signal. The loudness measure may be, e.g., the Dolby Digital dialnorm value.

Alternatively, the loudness measure may be stored as Replay Gain value. The Replay Gain value may be stored in iTunes style metadata or ID3v2 tags. In a further alternative, the loudness measure may be may be used to overwrite the MPEG "Program Reference Level". The MPEG "Program Reference Level" may be located in the Fill Element in the MPEG 4 AAC bit-stream as part of the Dynamic Range Compression (DRC) information structure (ISO/IEC 14496-3 Subpart 4).

The operation of block switching submodule 311 in combination with MDCT transform submodule 312 is described in the following.

According to HE-AAC, frames including a number of MDCT (Modified Discrete Cosine Transform) coefficients are generated during encoding. Typically, two types of blocks, long and short blocks, may be distinguished. In an embodiment, a long block equals the size of a frame (i.e. 1024 spectral coefficients which corresponds to a particular time resolution). A short block comprises 128 spectral values to achieve eight times higher time resolution (1024/128) for proper representation of the audio signals characteristics in time and to avoid pre-echo-artifacts. Consequently, a frame is formed by eight short blocks on the cost of reduced frequency resolution by the same factor eight. This scheme is usually referred to as the "AAC Block-Switching Scheme" which may be performed in block switching submodule 311. I.e. the block switching module 311 determines whether to generate long blocks or short blocks. While short blocks have a lower frequency resolution, short blocks provide valuable information for determining the onsets in an audio signal, and thus rhythmic information. This is particularly relevant for audio and speech signals which contain numerous sharp onsets and consequently a high number of short blocks for high quality representation.

Figure 4:
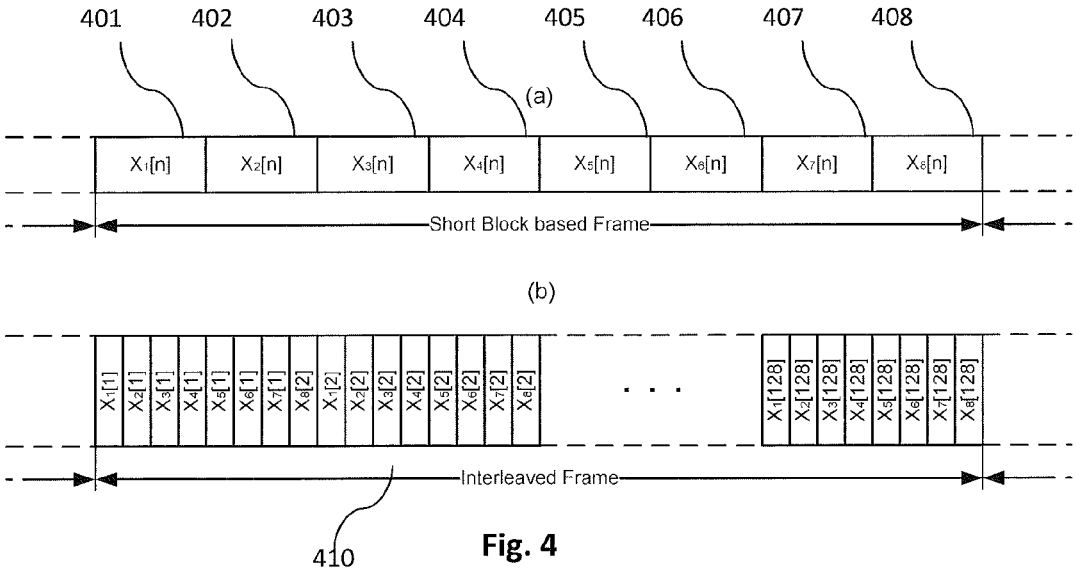
FIG. 4 shows an example of interleaving MDCT coefficients for short blocks.

For frames comprising short blocks, interleaving of MDCT coefficients to a long block is proposed, said interleaving being performed by submodule 330. The interleaving is shown in FIG. 4, where the MDCT coefficients of the 8 short blocks 401 to 408 are interleaved such that respective coefficients of the 8 short blocks are regrouped, i.e. such that the first MDCT coefficients of the 8 blocks 401 to 408 are regrouped, followed by the second MDCT coefficients of the 8 blocks 401 to 408, and so on. By doing this, corresponding MDCT coefficients, i.e. MDCT coefficients which correspond to the same frequency, are grouped together. The interleaving of short blocks within a frame may be understood as an operation to "artificially" increase the frequency resolution within a frame. It should be noted that other means of increasing the frequency resolution may be contemplated.

In the illustrated example, a block 410 comprising 1024 MDCT coefficients is obtained for a sequence of 8 short blocks. Due to the fact that the long blocks also comprise 1024 MDCT coefficients, a complete sequence of blocks comprising 1024 MDCT coefficients is obtained for the audio signal. I.e. by forming long blocks 410 from eight successive short blocks 401 to 408, a sequence of long blocks is obtained.

The encoder may use two different windows for processing different types of audio signals. A window describes how many data samples are used for the MDCT analysis. One encoding modus may be using a long block with a block size of 1024 samples. In case of transient data, the encoder may assemble a set of 8 short blocks. Each short block may have 128 samples, and therefore a MDCT length of 2*128 samples. Short blocks are used to avoid a phenomenon called pre-echo. This leads to a problem in the computation of spectral features, since these may expect a number 1024 MDCT samples. Since the occurrence of a group of short blocks is low, some kind of workaround can be used for this problem. Every set of 8 short blocks may be resembled to one long block. The first 8 indices of the long block come from index number one from each of the 8 short blocks as illustrated in FIG. 4. The second 8 indices, from the second index from each of the 8 short blocks and so on.

Block switching submodule 311, which is responsible for detecting transients in the audio signal, may work with computing the energy for blocks of 128 time samples.

Two features work with the energy of the signal: PCM and LRM. In addition, the SRM feature works with the variance of the signal. The difference of the variance and the energy of the signal is that the variance is calculated from the offset free time signal. Since the encoder has already removed the offset before handing it over to the filter bank, the difference in calculating the variance and energy in the encoder is almost void. According to an embodiment, it is possible to calculate the LRM, PCM and the RPM features using the block energy estimates.

The AdaBoost algorithm may need a specific vector for every sampling rate and may get initiated accordingly. The accuracy of the implementation may therefore depend on the used sample rate.

The computed energies may be fed from block switching module 311 over optional downmixer module 322 to SRM submodule 208, LRM submodule 209 and PCM submodule 205.

Whereas LRM submodule 209 and PCM submodule 205 work on the signal energy, as discussed above, SRM submodule 208 works with the variance of the signal. As mentioned above, the signal offset is removed so that the difference between the variance and the energy can be neglected.

Coming back to FIG. 3, the operation of submodule 330 is further described in the following. Submodule 330 receives MDCT coefficients from MDCT transform submodule 312 and may handle short blocks as described in the previous paragraphs. The MDCT coefficients may be used to calculate a pseudo spectrum. The pseudo spectrum $Y_m$ may be calculated from the MDCT coefficients $X_m$ as $$Y_m = (X_m^2 + (X_{m-1} - X_{m+1})^2)^{\frac{1}{2}}$$

Figure 5A:
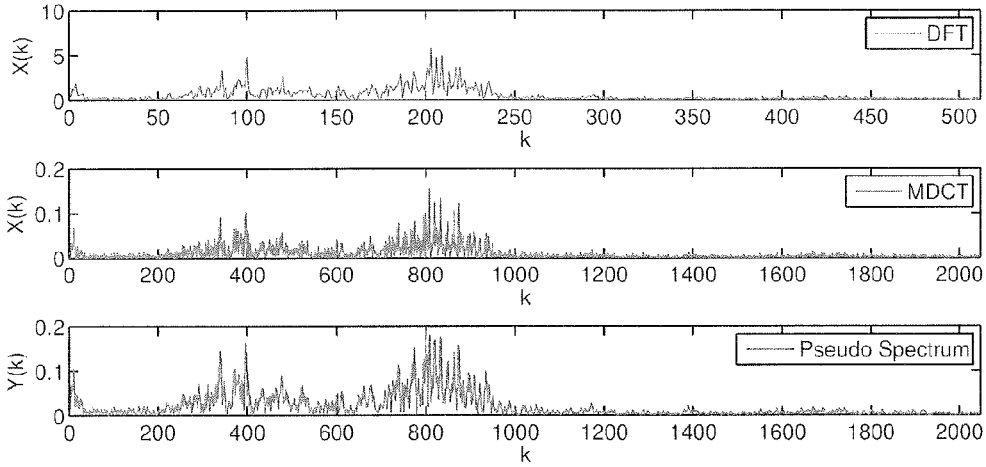
FIG. 5*a* illustrates a spectral representation of an example audio signal generated by different spectral transforms.

The equation above describes a way to calculate the pseudo spectrum from the MDCT coefficients to get closer to a spectral analysis with a DFT, by averaging the actual bin with the adjacent bins. An example of a spectrum generated by DFT, MDCT coefficients and pseudo spectrum is shown in FIG. 5*a*.

Figure 5B:
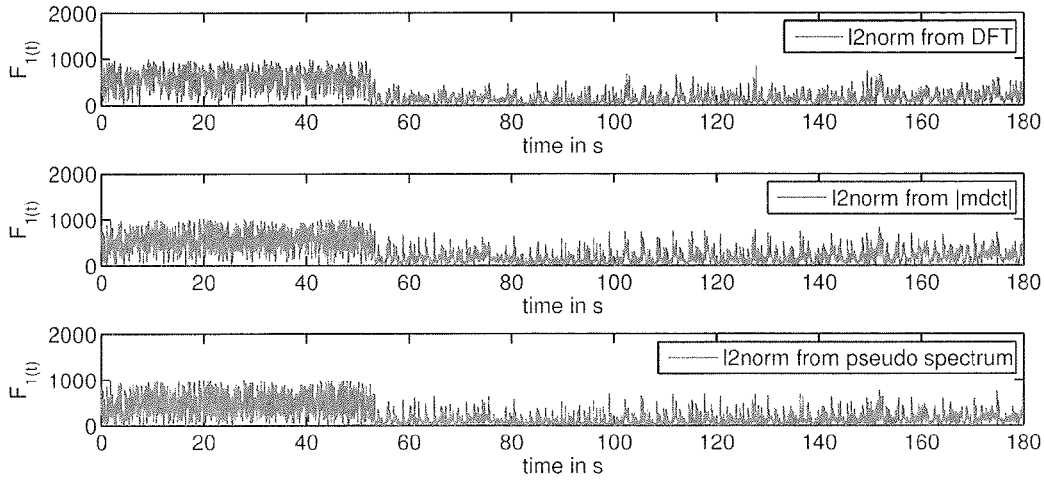
FIG. 5*b* illustrates the spectral flux of an example audio signal calculated by different spectral transforms.

The pseudo spectrum may be fed to SFV submodule 203 which calculates the spectral flux variance on basis of the pseudo spectrum provided by submodule 330. Alternatively, MDCT may be used as shown in FIG. 5*b* where $F_1(t)$ is calculated from DFT data, MDCT data and pseudo spectrum data. In another alternative, QMF data may be used, for example when encoding the input audio signal using HE-AAC. In this case, SFV submodule 203 may receive QMF data from a SBR submodule.

It should be noted that although the speech/non-speech classification has been described in FIG. 3 in combination with an encoder, it is clear that the speech/non-speech classification may also be practiced in another context as long as the relevant information from the submodules is provided.

In an embodiment, some additional processing is performed to replace the DFT spectral representation with the MDCT representation and the calculation of the SFV and AST features. For example, the filter bank data may be passed to the dialnorm calculation module as right and left channel. A simple downmix of both channels may be done by adding the left and the right channel $X_{kmono}=X_{kleft}+X_{kright}$. After the downmix there are several possibilities to feed the data into the spectral flux calculation. One approach is to use the MDCT-coefficients for the spectral analysis in the SFV by computing the magnitude of the MDCT coefficients. Another approach is to derive the pseudo spectrum from the MDCT coefficients.

Moreover, the pseudo spectrum calculated from the MDCT coefficients may be used to calculate the average spectral tilt. In this case, the pseudo spectrum may be fed from submodule 330 to AST submodule 204. Alternatively, the MDCT coefficients may be used to calculate the average spectral tilt. In this case, the MDCT coefficients may be fed from submodule 312 to AST submodule 204. In a further alternative, scalefactor band energies may be used for calculating the average spectral tilt. In this case, the scalefactor band energies submodule 313 may feed the scalefactor band energies to AST submodule 204 which calculates a measure for the average spectral tilt from the scalefactor band energies. Heretofore, it should be noted that the scalefactor band energies are energy estimates from frequency bands, derived from the MDCT spectrum.

According to an embodiment, the scale factor band energies are used to substitute the spectral power density used for calculating the average spectral tilt as described above. An example table for MDCT index o_sets (Nm) for a sample rate of 48 kHz is shown in the table below. The calculation of the scalefactor energies is as follows:

$$Z_m = \sum_{n=N_m}^{N_{m+1}-1} |x_n^2| \text{for } 0 < m \leq 46$$

$$Z_m = \text{Scalefactor band}(sfb) \text{ energy of index } m$$

$$x_n = MDCT \text{ coef of index } n \text{ for } 0 < n \leq 1023$$

$$N_m = MDCT \text{ index offset for } sfb \text{ with index } m$$

The conversion into the log-domain is equal to the conversion described above with the difference of using only 46 sfb energies instead of 1024 bins.

$$Z_m^{dB} = 10 \cdot \log_{10}(Z_m) \text{for } 0 < m \leq 46$$

In other words, the AST may be derived my modifying the DFT based formulas given above in the following way:

- replace DFT levels X[k] by scale factor band levels Z[k] (set m to k)
- k runs now from 1 to 46 (number of used scale factor bands)
- m is the time block index (block size is 1024 samples)
- the factor N/2 has to be replaced by the number of used scale factor bands (46)
- M corresponds to the number of blocks (of size 1024 samples) in a 2 second time window
- t corresponds to the current estimation time (covering the past 2 seconds)
- if the AST is computed every 0.5 seconds, the sampling interval for t is 0.5 s Other examples to convert scalefactor band energies for different signal settings are apparent to the skilled person and within the scope of the present document.

scalefactor bands for a window length of 2048 and 1920 (values for 1920 in brackets for LONG WINDOW, LONG START WINDOW, LONG STOP WINDOW at 22.05 and 24 kHz

| fs [kHz] | 22.05 and 24 |
|---|---|
| num_swb_long_window | 47 |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 44 |
| 12 | 52 |
| 13 | 60 |
| 14 | 68 |
| 15 | 76 |
| 16 | 84 |
| 17 | 92 |
| 18 | 100 |
| 19 | 108 |
| 20 | 116 |
| 21 | 124 |
| 22 | 136 |
| 23 | 148 |
| 24 | 160 |
| 25 | 172 |
| 26 | 188 |
| 27 | 204 |
| 28 | 220 |
| 29 | 240 |
| 30 | 260 |
| 31 | 284 |
| 32 | 308 |
| 33 | 336 |
| 34 | 364 |
| 35 | 396 |
| 36 | 432 |
| 37 | 468 |
| 38 | 508 |
| 39 | 552 |
| 40 | 600 |
| 41 | 652 |
| 42 | 704 |
| 43 | 768 |
| 44 | 832 |
| 45 | 896 |
| 46 | 960 |
| | 1024 (—) |

Scalefactor bands (SFB) may be advantageously used because of the complexity reduction of the feature. It is less complex to take 46 scalefactor bands into account compared to the full MDCT spectrum of 1024 bins. The scalefactor band energies are energy estimates from different frequency bands, derived from the MDCT spectrum. These estimates are used in the encoder for the psychoacoustic model of the encoder to derive the tolerated quantization error in each scalefactor band.

According to another aspect of the present document, a new feature for classification of speech/non-speech parts of audio content is proposed. The proposed feature is related to the estimation of rhythm information for audio signals since this property of the audio signal carries useful information for classification of speech or non-speech. The proposed rhythmic feature can then be used in addition to other features in a classifier such as the AdaBoost classifier to make decisions on parts or segments of audio.

For efficiency purpose, it may be desirable to extract rhythmic information from the audio signal directly or the data calculated by the encoder for insertion into the bit-stream. In the following, a method is described on how to determine rhythmic information of audio signals. A particular focus is made on HE-AAC encoder.

HE-AAC encoding makes use of High Frequency Reconstruction (HFR) or Spectral Band Replication (SBR) techniques. The SBR encoding process comprises a Transient Detection Stage, an adaptive T/F (Time/Frequency) Grid Selection for proper representation, an Envelope Estimation Stage and additional methods to correct a mismatch in signal characteristics between the low-frequency and the high-frequency part of the signal.

It has been observed that most of the payload produced by the SBR-encoder originates from the parametric representation of the envelope. Depending on the signal characteristics, the encoder determines a time-frequency resolution suitable for proper representation of the audio segment and for avoiding pre-echo-artefacts. Typically, a higher frequency resolution is selected for quasi-stationary segments in time, whereas for dynamic passages, a higher time resolution is selected.

Consequently, the choice of the time-frequency resolution has significant influence on the SBR bit-rate, due to the fact that longer time-segments can be encoded more efficiently than shorter time-segments. At the same time, for fast changing content, i.e. typically for audio content having a higher rhythm, the number of envelopes and consequently the number of envelope coefficients to be transmitted for proper representation of the audio signal is higher than for slow changing content. In addition to the impact of the selected time resolution, this effect further influences the size of the SBR data. As a matter of fact, it has been observed that the sensitivity of the SBR data rate to tempo or rhythm variations of the underlying audio signal is higher than the sensitivity of the size of the Huffman code length used in the context of mp3 codecs. Therefore, variations in the bit-rate of SBR data have been identified as valuable information which can be used to determine rhythmic components directly from the encoded bit-stream. Thus, SBR payload is a good proxy to estimate onsets in audio signals. The SBR-derived rhythmic information can then be used as a feature for speech/non-speech classification, e.g. for gating the calculation of loudness.

The size of the SBR payload can be used for rhythmic information. The amount of SBR payload may be received directly from the SBR component of the encoder.

Figure 7A:
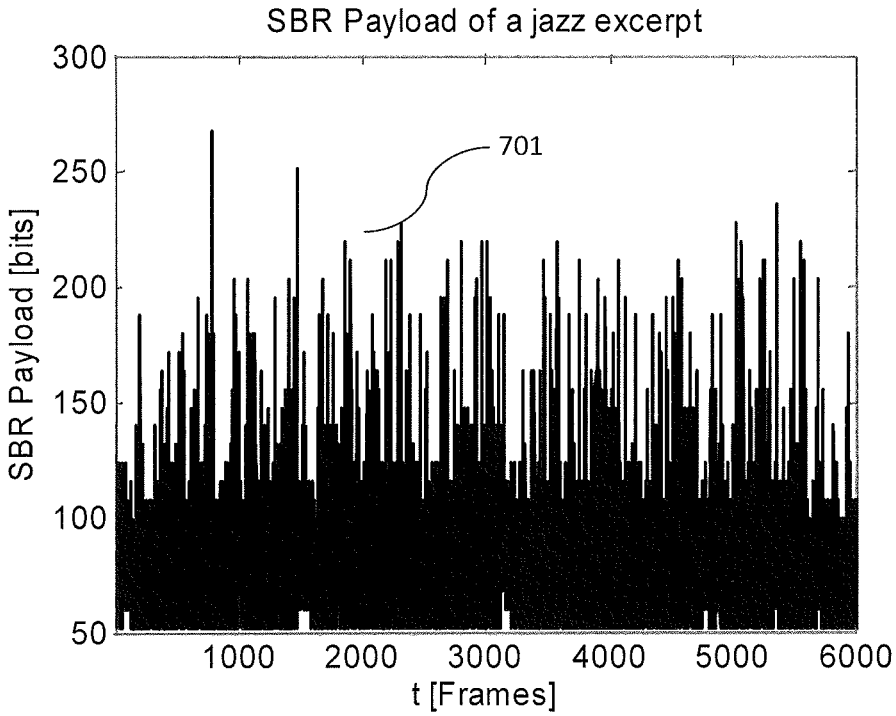
FIG. 7 illustrates an example sequence of SBR payload size and resulting modulation spectra.

An example for a suite of SBR payload data is given in FIG. 7*a*. The x-axis shows the frame number, whereas the y-axis indicates the size of the SBR payload data for the corresponding frame. It can be seen that the size of the SBR payload data varies from frame to frame. In the following, it is only referred to the SBR payload data size. Rhythmic information may be extracted from the sequence 701 of the size of SBR payload data by identifying periodicities in the size of SBR payload data. In particular, periodicities of peaks or repetitive patterns in the size of SBR payload data may be identified. This can be done, e.g. by applying a FFT on overlapping sub-sequences of the size of SBR payload data. The sub-sequences may correspond to a certain signal length, e.g. 6 seconds. The overlapping of successive sub-sequences may be a 50% overlap. Subsequently, the FFT coefficients for the sub-sequences may be averaged across the length of the complete audio track. This yields averaged FFT coefficients for the complete audio track, which may be represented as a modulation spectrum 711 shown in FIG. 7*b*. It should be noted that other methods for identifying periodicities in the size of SBR payload data may be contemplated.

Peaks 712, 713, 714 in the modulation spectrum 711 indicate repetitive, i.e. rhythmic patterns with a certain frequency of occurrence. The frequency of occurrence may also be referred to as modulation frequency. It should be noted that the maximum possible modulation frequency is restricted by the time-resolution of the underlying core audio codec. Since HE-AAC is defined to be a dual-rate system with the AAC core codec working at half the sampling frequency, a maximum possible modulation frequency of around 21.74 Hz/2~11-Hz is obtained for a sequence of 6 seconds length (128 frames) and a sampling frequency $F_s$=44100 Hz. This maximum possible modulation frequency corresponds with approx. 660 BPM, which covers the tempo/rhythm of speech and almost every musical piece. For convenience while still ensuring correct processing, the maximum modulation frequency may be limited to 10 Hz, which corresponds to 600 BPM.

Figure 6:
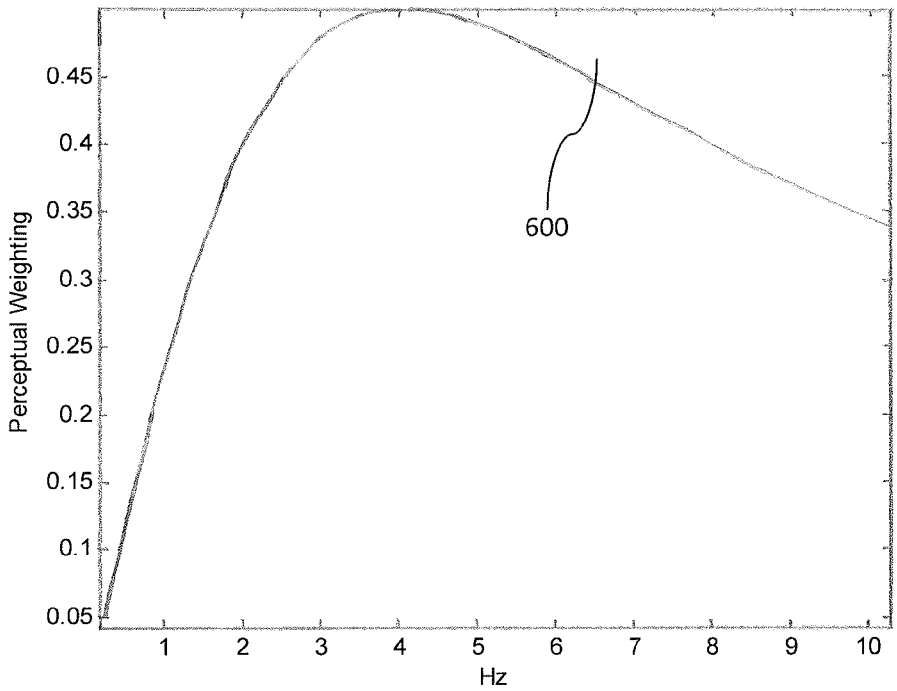
FIG. 6 illustrates an example for a weighting function.
Figure 7B:
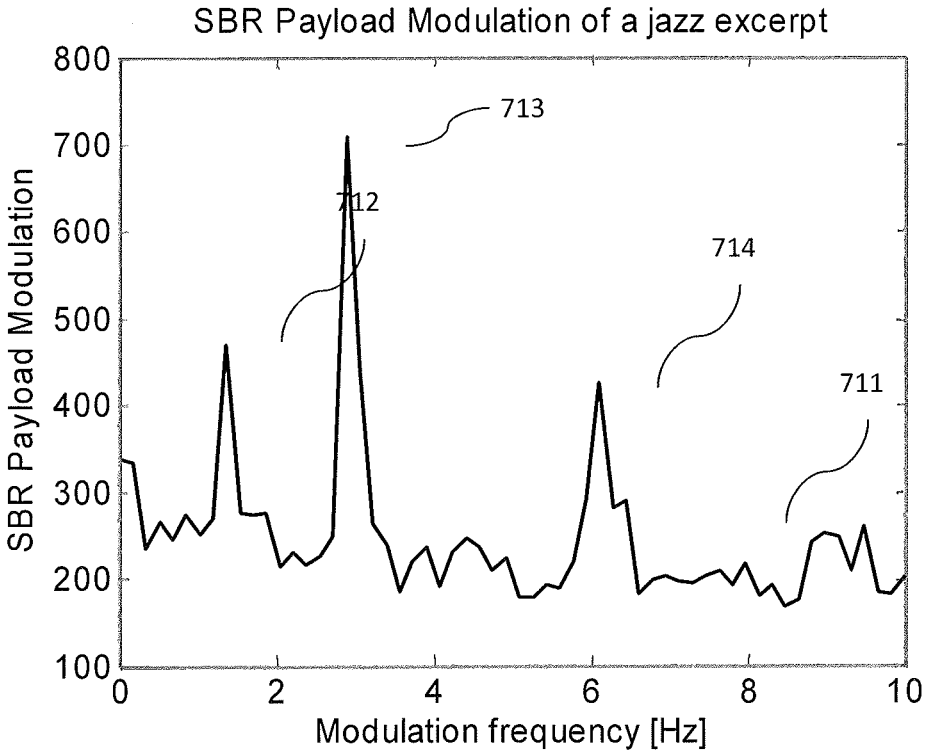
Figure 7C:
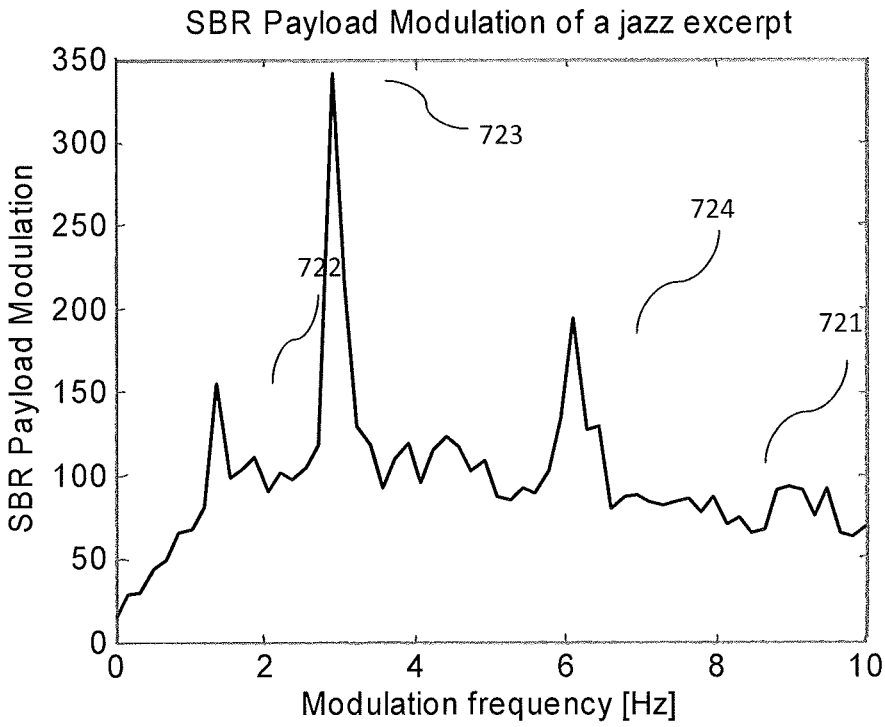

The modulation spectrum of FIG. 7*b* may be further enhanced. For instance, perceptual weighting using a weighting curve 600 shown in FIG. 6 may be applied to the SBR payload data modulation spectrum 711 in order to model the human tempo/rhythm preferences. The resulting perceptually weighted SBR payload data modulation spectrum 721 is shown in FIG. 7*c*. It can be seen that very low and very high tempi are suppressed. In particular, it can be seen that the low frequency peak 722 and the high frequency peak 724 have been reduced compared to the initial peaks 712 and 714, respectively. On the other hand, the mid frequency peak 723 has been maintained.

Figure 7D:
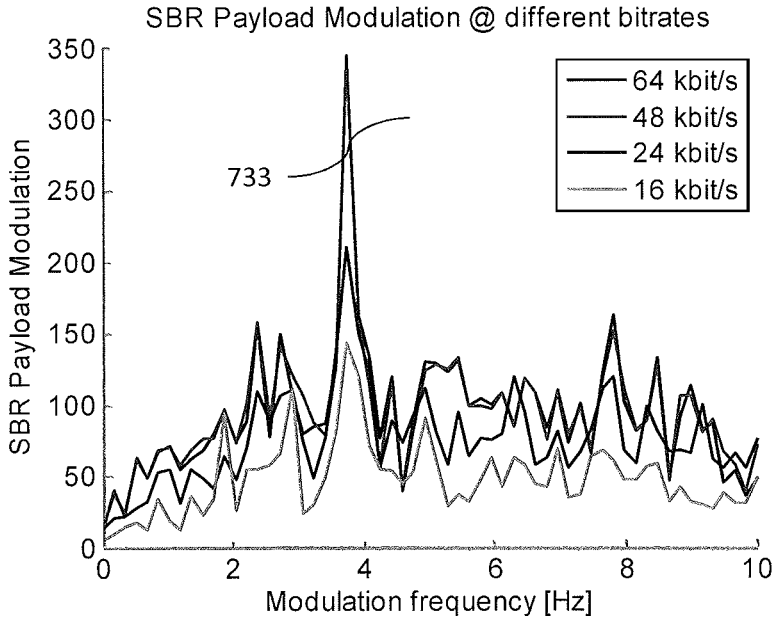

It should be noted that the proposed approach for rhythm estimation based on SBR payload data is independent from the bit-rate of the input signal. When changing the bit-rate of an HE-AAC encoded bit-stream, the encoder automatically sets up the SBR start and stop frequency according to the highest output quality achievable at this particular bit-rate, i.e. the SBR cross-over frequency changes. Nevertheless, the SBR payload still comprises information with regards to repetitive transient components in the audio track. This can be seen in FIG. 7*d*, where SBR payload modulation spectra are shown for different bit-rates (16 kbit/s up to 64 kbit/s). It can be seen that repetitive parts (i.e., peaks in the modulation spectrum such as peak 733) of the audio signal stay dominant over all the bitrates. It may also be observed that fluctuations are present in the different modulation spectra because the encoder tries to save bits in the SBR part when decreasing the bit-rate.

The resulting rhythmic feature is a good feature for speech/non-speech classification. Different types of classifiers may be applied to decide whether an audio signal is a speech signal or relates to other signal types. For instance, the AdaBoost classifier may be used to weight the rhythmic feature and other features for classification. The rhythmic feature may be applied instead of or in addition to similar features related to rhythm, for instance, Short Rhythmic Measure (SRM) and/or Long Rhythmic Measure (LRM) used in the dialnorm calculation of the HE-AAC encoder.

It should be noted that the methods outlined for rhythmic feature estimation and speech classification in the present document may be applied for gating the calculation of a loudness value such as dialnorm in HE-AAC. The proposed methods make use of the calculations in the SBR component of the encoder and do not add much computational load.

As a further aspect, it should be noted that the speech/non-speech classification and/or the loudness information of an audio signal may be written into the encoded bit-stream in the form of metadata. Such metadata may be extracted and used by a media player.

In the present document, a speech/non-speech classifier and gated loudness estimation method and system has been described. The estimation may be performed based on the HE-AAC SBR payload as determined by the encoder. This allows the determination of rhythmic feature at very low complexity. Using the SBR payload data rhythmic feature may be extracted. The proposed method is robust against bit-rate and SBR cross-over frequency changes and can be applied to mono and multi-channel encoded audio signals. It can also be applied to other SBR enhanced audio coders, such as mp3PRO and can be regarded as being core codec agnostic.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the internet. Typical devices making use of the methods and systems described in the present document are portable electronic devices or other consumer equipment which are used to store and/or render audio signals. The methods and system may also be used on computer systems, e.g. internet web servers, which store and provide audio signals, e.g. music signals, for download.

The invention claimed is:

1. A method for encoding an audio signal, the method comprising:

determining a spectral representation of the audio signal, the determining a spectral representation comprising determining modified discrete cosine transform, MDCT, coefficients;

encoding the audio signal using the determined spectral representation;

determining a pseudo spectrum from the MDCT coefficients, wherein determining the pseudo spectrum comprises, for a particular MDCT coefficient $X_m$ in a particular frequency bin m, determining a corresponding coefficient $Y_m$ of the pseudo spectrum as $$Y_m = (X_m^2 + (X_{m-1} - X_{m+1})^2)^{\frac{1}{2}},$$

wherein $X_{m-1}$ and $X_{m+1}$ are MDCT coefficients in frequency bins m−1 and m+1, respectively, adjacent to the particular frequency bin m;

classifying parts of the audio signal to be speech parts or non-speech parts based at least in part on the determined pseudo spectrum; and determining a loudness measure for the audio signal based on the speech parts.

2. The method of claim 1, wherein the spectral representation is determined for short blocks and/or long blocks, the method further comprising:

aligning the short block representation with a frame for a long block representation corresponding to a predetermined number of short blocks, thereby reordering MDCT coefficients of the predetermined number of short blocks into the frame for a long block.

3. The method claim 1, further comprising:

encoding the audio signal using the determined spectral representation into a bit-stream; and encoding the determined loudness measure into the bit-stream.

4. The method of claim 1, wherein the audio signal is a multi-channel signal, the method further comprising:

downmixing the multi-channel audio signal and performing the classification step on the downmixed signal.

5. The method of claim 1, further comprising:

downsampling the audio signal and performing the classification step on the downsampled signal.

6. A non-transitory storage medium comprising a software program, which when executed on a computing device, causes the computing device to perform the method of claim 1.

7. A system for encoding an audio signal, the system comprising:

means for determining a spectral representation of the audio signal, the means for determining a spectral representation of the audio signal being configured to determine modified discrete cosine transform, MDCT, coefficients;

means for encoding the audio signal using the determined spectral representation;

means for determining a pseudo spectrum from the MDCT coefficients, wherein determining the pseudo spectrum comprises, for a particular MDCT coefficient $X_m$, in a particular frequency bin m, determining a corresponding coefficient $Y_m$ of the pseudo spectrum as $Y_m=(X_m^2+(x_{m-1}-X_{m+1})^2)^{1/2}$, wherein $X_{m-1}$ and $X_{m+}$are MDCT coefficients in frequency bins m−1 and m+1, respectively, adjacent to the particular frequency bin m;

means for classifying parts of the audio signal to be speech parts or non-speech parts based at least in part on the determined pseudo spectrum; and means for determining a loudness measure for the audio signal based on the speech parts.

* * * * *